US009277305B2

(12) United States Patent
Kwon et al.

(10) Patent No.: US 9,277,305 B2
(45) Date of Patent: Mar. 1, 2016

(54) SUSPENSION FOR A SOUND TRANSDUCER

(71) Applicant: Em-Tech. Co., Ltd., Busan (KR)

(72) Inventors: Joong Hak Kwon, Gyeongju Gyeongsangbuk-do (KR); Ho Il Jeong, Gyeongsanbuk-do (KR); Kyu Dong Choi, Gyeongsangnam-do (KR); In Ho Jeong, Gyeongsangnam-do (KR)

(73) Assignee: EM-TECH. Co., Ltd., Busan (KR)

( * ) Notice: Subject to any disclaimer, the term of this patent is extended or adjusted under 35 U.S.C. 154(b) by 42 days.

(21) Appl. No.: 13/952,919

(22) Filed: Jul. 29, 2013

(65) Prior Publication Data

US 2014/0029784 A1 Jan. 30, 2014

(30) Foreign Application Priority Data

Jul. 30, 2012 (KR) ..... 10-2012-0082971

(51) Int. Cl.

| | |
|---|---|
| ***H04R 7/10*** | (2006.01) |
| ***H04R 1/02*** | (2006.01) |
| ***H04R 7/20*** | (2006.01) |
| ***H04R 9/04*** | (2006.01) |

(52) U.S. Cl.

CPC .. *H04R 1/02* (2013.01); *H04R 7/10* (2013.01); *H04R 7/20* (2013.01); *H04R 9/043* (2013.01)

(58) Field of Classification Search

CPC ..... H04R 9/04; H04R 9/043; H04R 9/046; H04R 7/10; H04R 7/16; H04R 7/18; H04R 2207/021; H04R 2307/204; H04R 2307/207; H04R 2400/07

USPC ..... 381/176, 398, 399, 423, 424, 426, 427, 381/431; 181/157, 164–174

See application file for complete search history.

(56) References Cited

U.S. PATENT DOCUMENTS

| | | | | |
|---|---|---|---|---|
| 6,853,734 | B2 * | 2/2005 | Sahyoun | 381/404 |
| 2004/0008860 | A1 | 1/2004 | Wu | |
| 2005/0147272 | A1 * | 7/2005 | Hyre et al. | 381/398 |
| 2006/0215874 | A1 | 9/2006 | Jiles et al. | |
| 2011/0026757 | A1 * | 2/2011 | Takahashi et al. | 381/397 |
| 2013/0133975 | A1 | 5/2013 | Kim et al. | |

FOREIGN PATENT DOCUMENTS

WO 2012023709 A2 2/2012

OTHER PUBLICATIONS

Extended European Search Report for European Application 13003696.5 (Jan. 21, 2014).

* cited by examiner

*Primary Examiner* — Ahmad F Matar
*Assistant Examiner* — Sabrina Diaz
(74) *Attorney, Agent, or Firm* — Murphy, Bilak & Homiller, PLLC

(57) ABSTRACT

An object of the present invention is to provide a suspension for a sound transducer which has a central portion serving as a center diaphragm and which has a cover layer and a copper pattern partially removed to prevent a decrease in sound pressure from being caused by an increase in weight of a vibration system. According to the present invention, there is provided a suspension for a sound transducer which includes a central portion, a peripheral portion, and a support portion for connecting the central portion to the peripheral portion, the suspension comprising: a base film, a conductive film attached on the base film by means of an adhesive, and a cover layer attached on the conductive film by an adhesive, wherein at least part of the cover layer disposed on the central portion is removed.

13 Claims, 6 Drawing Sheets

SUSPENSION FOR A SOUND TRANSDUCER

TECHNICAL FIELD

The present invention relates to a suspension for a sound transducer, and more particularly, to a suspension for a sound transducer which is made of an FPCB to transfer electrical signals to a voice coil and which has a central portion serving as a center diaphragm.

BACKGROUND ART

Sound reproducing technologies of mobile multimedia have been developed along with mobile communication technologies, which require high performance, high sound quality, and high output of a microspeaker.

In most cases, a conventional microspeaker does not employ a suspension so as to achieve a light weight of a diaphragm, and a lead wire of a voice coil is bonded to the diaphragm so that external electrical signals can be applied to the voice coil. Thus, a partial vibration often occurs due to the absence of the suspension, and the lead wire of the coil is often down due to a tensile force in high outputs, which makes it difficult to use the microspeaker in high output applications.

In order to solve the foregoing problem, a microspeaker has been suggested that uses a suspension made of an FPCB with a conductive pattern for transferring electrical signals. FIG. 1 shows a general suspension made of an FPCB, wherein a conductive film 20 made of copper or the like is disposed on a base film 10 made of a PI having good thermal properties, and a cover layer 30 is attached thereon to protect the conductive film 20. In addition, the base film 10, the conductive film 20 and the cover layer 30 are attached to one another by means of adhesives 41, 42, 43 and 44.

With respect to the microspeaker using the suspension, an increase in weight of the vibration system, which results from the application of the suspension, causes a decrease in sound pressure of the microspeaker. Additionally, cracks may be formed on the conductive film 20 in high outputs, which leads to defects. In order to prevent a decrease in sound pressure, it is possible to reduce the weight of the vibration system by appropriately adjusting the shapes of the cover layer 30 and the conductive film 20 of the suspension. However, as the diaphragm gets thinner, a local vibration mode of the diaphragm occurs in high frequency regions, to which has a detrimental effect on sound properties. Therefore, it is necessary to appropriately adjust the shapes of the cover layer 30 and the conductive film 20 to prevent such a local vibration mode.

DISCLOSURE OF THE INVENTION

An object of the present invention is to provide a suspension for a sound transducer which has a central portion serving as a center diaphragm and which has a cover layer and a copper pattern partially removed to prevent a decrease in sound pressure from being caused by an increase in weight of a vibration system.

Another object of the present invention is to provide a suspension for a sound transducer which can achieve a light weight by adjusting the shapes of a cover layer and a copper pattern.

According to an aspect of the present invention for achieving the above objects, there is provided a suspension for a sound transducer which includes a central portion, a peripheral portion, and a support portion for connecting the central portion to the peripheral portion, the suspension comprising:

a base film, a conductive film attached on the base film by means of an adhesive, and a cover layer attached on the conductive film by an adhesive, at least part of the cover layer disposed on the central portion being removed.

In addition, at least part of the cover layer disposed on the support portion is removed.

Moreover, the support portions are provided in four directions, respectively, which include a pair of long support portions and a pair of short support portions, the cover layer disposed on the long support portions is entirely removed, and only parts of the cover layer disposed on the short support portions that are adjacent to the central portion are removed.

Additionally, the conductive film disposed on the central portion is entirely removed, except part of the periphery of the central portion.

Furthermore, the conductive film and the cover layer are attached to both faces of the base film, and only the cover layer on the central portion that is attached to one face is removed.

Still furthermore, the conductive film and the cover layer are attached to both faces of the base film, and at least parts of the respective cover layers on the central portion are removed.

Still furthermore, the conductive film and the cover layer are attached to both faces of the base film, and the cover layers on the central portion that are attached to both faces are entirely removed.

Still furthermore, a center part of the cover layer disposed on the central portion is removed, except its periphery.

Still furthermore, plural parts of the cover layer disposed on the central portion are removed so that the removed parts can be formed in a stripe shape, spaced apart from one another.

Still furthermore, the cover layer disposed on the central portion is removed so that the removed part can be formed in a lattice shape.

Still furthermore, the cover layer disposed on the central portion is removed so that the removed part can be formed in a fishbone shape.

Still furthermore, the cover layer disposed on the central portion is removed so that the removed part can include a center-removed part and a ring-shaped part enclosing the center-removed part with a gap.

Still furthermore, the metal film disposed on the central portion is provided in such a shape that a split vibration does not occur in high frequency regions by the removed part of the cover layer.

The suspension for the sound transducer provided by the present invention can improve a sound pressure by removing part of the cover layer attached on the central portion to achieve a light weight of the vibrating portion.

In addition, the suspension for the sound transducer provided by the present invention can prevent a fatigue fracture of the metal film, which is caused by a difference in contraction and expansion ratio of the cover layer and the metal film, by removing the cover layer on one face of the support portion.

Moreover, the suspension for the sound transducer provided by the present invention can prevent a partial vibration from occurring in low frequencies due to a decrease in a supporting force of the suspension, by removing only parts of the cover layer attached on the short support portions that are adjacent to the central portion.

Additionally, the suspension for the sound transducer provided by the present invention can improve a sound pressure by achieving a light weight of the vibrating portion, by minimizing the area of the metal film attached on the central portion.

Furthermore, the suspension for the sound transducer provided by the present invention can prevent a split mode in high frequency regions, by forming the metal film, which is attached on the central portion, in a shape corresponding to the shape of the removed part of the cover layer.

BEST MODE FOR CARRYING OUT THE INVENTION

Hereinafter, the present invention will be described in more detail with reference to the drawings.

Figure 1:
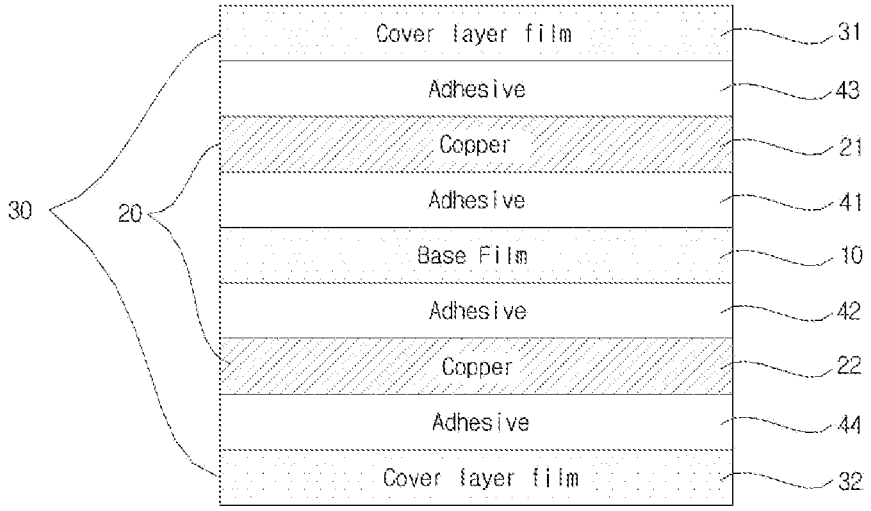
FIG. 1 is a sectional view showing a conventional suspension for a sound to transducer.
Figure 2:
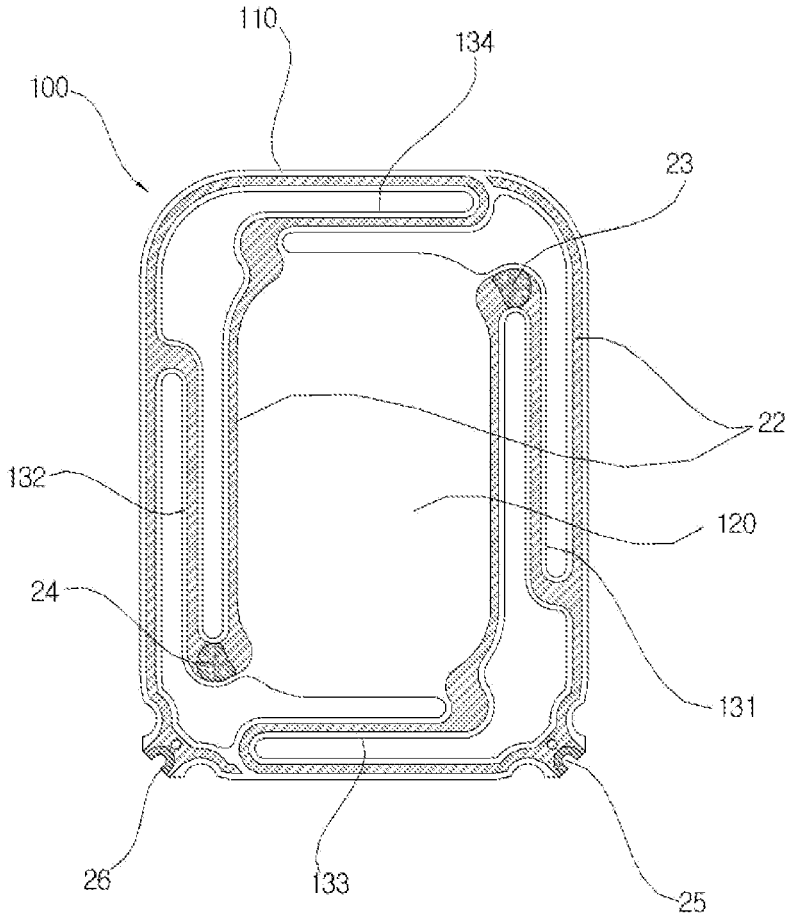
FIG. 2 is a view showing a lower pattern of a metal film provided in a suspension according to a first embodiment of the present invention.

FIG. 2 is a view showing a lower pattern of a metal film provided in a suspension according to a first embodiment of the present invention. As in the conventional suspension shown in FIG. 1, basically in the suspension according to the first embodiment of the present invention, metal films 20 are attached to upper and lower portions of a base film 10, and cover layers 30 are attached thereon to protect the metal films 20. The base film 10 of the suspension includes a central portion 120, a peripheral portion 110, and support portions 131, 132, 133 and 134 which connect the central portion 120 to the peripheral portion 110. An inner circumference of a side diaphragm (not shown) and a voice coil (not shown) are attached to the central portion 120, and an outer circumference of the side diaphragm (not shown) is attached to the peripheral portion 110. The peripheral portion 110 is formed in a ring shape with a gap from the central portion 120 and seated on a frame (not shown). The support portions 131, 132, 133 and 134 allow the central portion 120 to vibrate only in the vertical direction, when it vibrates due to the vibration of the voice coil (not shown).

A pair of lower metal films 22, which are separated from each other, are attached to the lower portion of the base film 10 (see FIG. 1), so that their (+) and (−) poles can be connected to lead-in wires of the voice coil, respectively. The lower metal films 22 are provided to be connected to the peripheral portion 110, the support portion 130 and the central portion 120, terminal lands 25 and 26 for connection to terminals for transferring electrical signals from an external device are formed at one side of the peripheral portion 110, and voice coil lands 23 and 24 are provided to solder the lead-in wires of the voice coil to the support portion 130 or the central portion 120. A cover layer 32 for protecting the metal film 22 is attached on the metal film 22, but is not provided on the terminal lands 25 and 26 and the voice coil lands 23 and 24 for the purpose of soldering.

Meanwhile, the lower metal films 22 are disposed along the periphery of the central portion 120, so that the lower metal films 20 formed on the neighboring support portions 132 and 134; 131 and 133 can be connected to each other. That is to say, the sound transducer generally formed in a rectangular shape has a pair of long sides and a pair of short sides, as all the components such as the diaphragm, suspension, magnetic circuit, etc. are formed in a rectangular shape. Thus, the support portions 131, 132, 133 and 134 also include long support portions 131 and 132, which are disposed on the long sides, and short support portions 133 and 134, which are disposed on the short sides. In turn, the metal films 22, which are formed on the neighboring long support portions 131 and 132 and short support portions 133 and 134, are connected to each other. The lower metal film 22, which connects the lower metal film 22 formed on the long support portion 131 and 132 to the lower metal film 22 formed on the short support portion 133 and 134, is disposed on both the peripheral portion 110 and the central portion 120. Here, the lower metal film 22, which connects the lower metal film 22 formed on the long support portion 131 and 132 disposed on the central portion to the lower metal film 22 formed on the short support portion 133 and 134 is preferably disposed on the long side of the central portion 120. The lower metal film 22 is disposed along the periphery of the long side of the central portion 120, thereby preventing a split vibration of the central portion 120 that may occur when the cover layer attached on the central portion 120 is removed, as discussed later.

Figure 3:
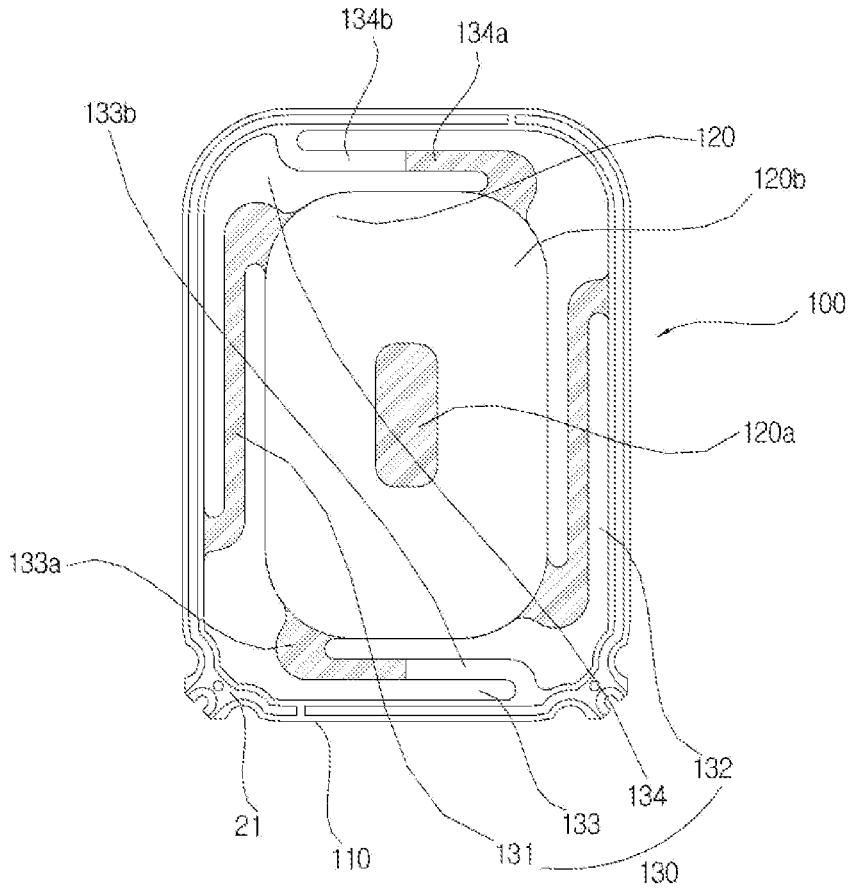
FIG. 3 is a view showing a state where part of an upper cover layer of the suspension according to the first embodiment of the present invention is removed.

FIG. 3 is a view showing a state where part of an upper cover layer of the suspension according to the first embodiment of the present invention is removed. In the suspension 100 according to the first embodiment of the present invention, an upper metal film 21 is disposed along the peripheral portion 110 on the base film 10 (see FIG. 5). In addition, an upper cover layer 31 (see FIG. 5) is attached on the upper metal film 21 to protect the upper metal film 21. Here, since the upper metal film 21 is provided only on the peripheral portion 110 of the suspension 100, the upper cover layer 31 (see FIG. 5) attached on the central portion 120 or the support portion 130 can be removed to reduce a weight. As described above, the central portion 120 or the support portion 130 is a vibrating portion, which vibrates when the voice coil (not shown) attached to the central portion 120 vibrates, in particular, the central portion 120 serves as a center diaphragm, and therefore reducing the weight of the vibrating portion is advantageous to improve a sound pressure.

The removed part of the upper cover layer 31 (see FIG. 5) is indicated by the shaded section in FIG. 3. There are a central portion-removed part 120*a* formed by removing the upper cover layer 31 (see FIG. 5) from the center of the central portion 120, and a central portion-remaining part 120*b* where the upper cover layer 31 (see FIG. 5) still remains. Moreover, with respect to the upper cover layer 31 (see FIG. 5) disposed on the support portion 130, the upper cover layer attached on the long support portions 131 and 132 is entirely removed, parts of the upper cover layer attached on the short support portions 133 and 134 that are adjacent to the central portion 120 become removed parts 133*a* and 134*a*, and the other parts 133*b* and 134*b* that are adjacent to the peripheral portion 110 become remaining parts 133*b* and 134*b*.

Figure 4:
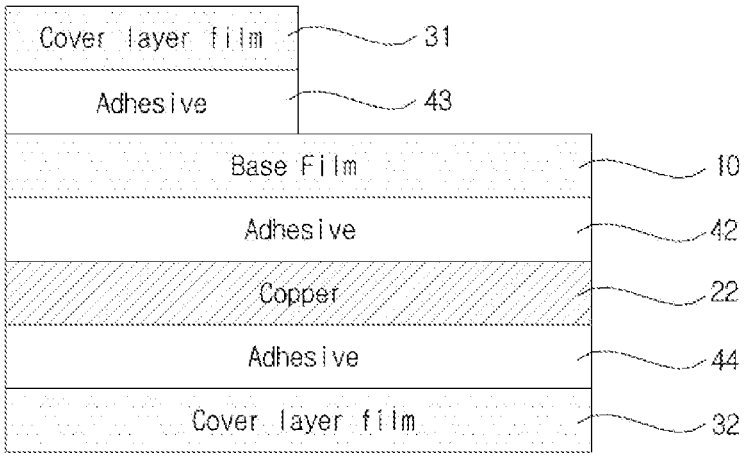
FIG. 4 is a schematic sectional view showing a state where the upper cover layer on the central portion of the suspension according to the first embodiment of the present invention is removed.
Figure 5:
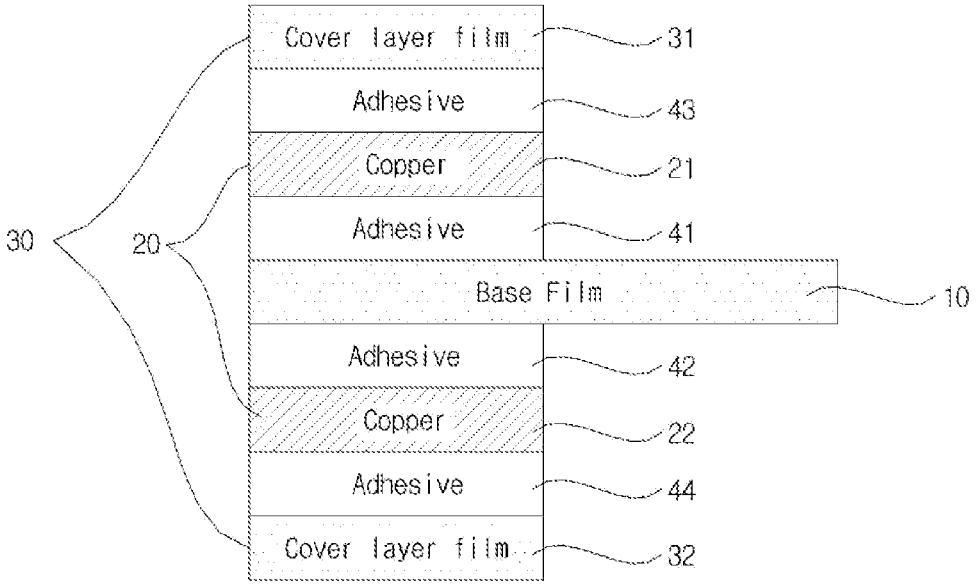
FIG. 5 is a schematic sectional view showing a state where both the upper and lower cover layers of the suspension according to the first embodiment of the present invention are removed.
Figure 6:
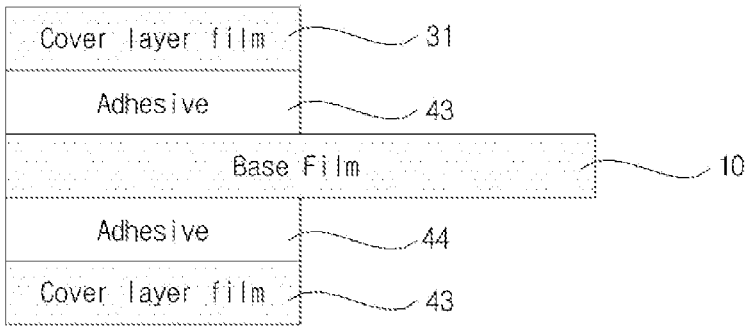
FIG. 6 is a schematic sectional view showing a state where both the upper and lower cover layers, in positions to which upper and lower metal films are not attached, of the central portion of the suspension according to the first embodiment of the present invention are removed.

FIG. 4 is a schematic sectional view showing a state where both the upper cover layer on the central portion of the suspension according to the first embodiment of the present invention is removed, FIG. 5 is a schematic sectional view showing a state where both the upper and lower cover layers of the suspension according to the first embodiment of the present invention are removed, and FIG. 6 is a schematic sectional view showing a state where both the upper and lower cover layers, in positions to which upper and lower metal films are not attached, of the central portion of the suspension according to the first embodiment of the present invention are removed. The upper metal film 21 and the lower metal film 22 are attached to upper and lower portions of the base film 10 by adhesives 41 and 42, the upper cover layer 31 is attached on the upper metal film 21 by an adhesive 43, and the lower cover layer 32 is attached on the lower metal film 22 by an adhesive 44. Here, since the upper metal film 21 is provided only on the peripheral portion 110 of the suspension 100, the lower cover layer 32 attached on the central portion 120 can be removed to reduce a weight. The central portion 120 or the support portion 130 is a vibrating portion, which vibrates when the voice coil (not shown) attached to the central portion 120 vibrates, and therefore reducing the weight of the vibrating portion is advantageous to improve a sound pressure. Since the lower metal film 22 attached on the central portion 120 is provided only on the periphery of the long sides of the central portion 120, the lower cover layer 32 attached on the central portion 120 is preferably removed to reduce the weight of to the vibrating portion, except the lower metal film 22-attached part.

The central portion-removed part 120*a* (see FIG. 3) formed by removing the upper cover layer 31 from the center of the central portion 120 has a sectional shape shown on the right side of FIG. 5, where the upper and lower conductive films 21 and 22 and the upper and lower cover layers 31 and 32 are entirely removed from the upper and lower portions of the base film 10. On the contrary, the peripheral portion 110 has a sectional shape shown on the left side of FIG. 5, where the upper and lower conductive films 21 and 22 and the upper and lower cover layers 31 and 32 entirely remain on the upper and lower portions of the base film 10 in an attached manner.

Further, the removed parts 131, 132, 133*a* and 134*a* formed by removing the upper cover layer 31 from the support portion 130 have a sectional shape shown on the right side of FIG. 4, where the lower metal film 22 and the lower cover layer 32 remain on the base film 10, and the upper metal film 21 and the upper cover layer 31 are removed. Furthermore, the remaining parts 133*b* and 134*b*, where the upper cover layer 31 still remains on the support portion 130, have a sectional shape shown on the left side of FIG. 4, where the lower metal film 22, the lower cover layer 32 and the upper cover layer 31 are attached on the base film 10.

Additionally, the remaining part 120*b* (see FIG. 3), where the upper cover layer 31 remains on the central portion 120, has a sectional shape shown on the right side of FIG. 6, where the upper and lower cover layers 31 and 32 are attached to the upper and lower portions of the base film 10. However, the periphery of the central portion 120, where the lower metal film 22 is formed, has a sectional shape shown on the left side of FIG. 4, where the lower metal film 22, the lower cover layer 32 and the upper cover layer 31 are attached on the base film 10.

Figure 7:
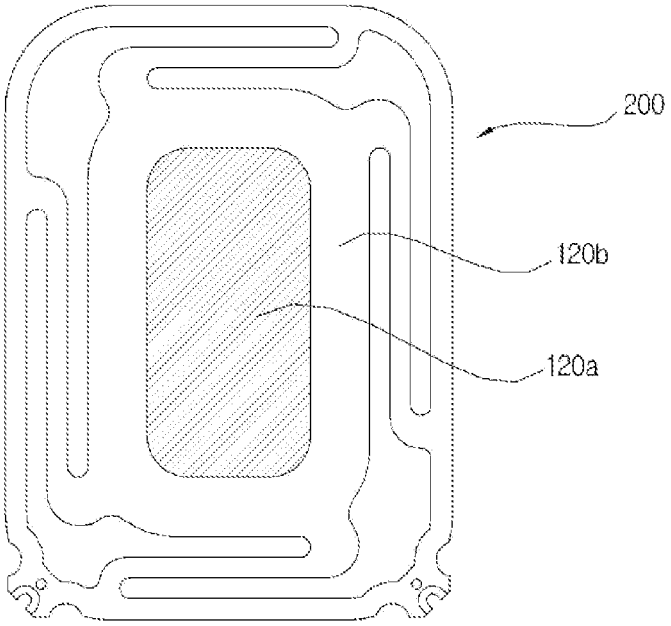
FIG. 7 is a view showing a state where part of an upper cover layer of a suspension according to a second embodiment of the present invention is removed.

FIG. 7 is a view showing a state where part of an upper cover layer of a suspension according to a second embodiment of the present invention is removed. The suspension 200 according to the second embodiment of the present invention includes a central portion-removed part 220*a* and a central portion-remaining part 220*b* as in the first embodiment, but the central portion-removed part 220*a* is larger than that of the first embodiment. The lower conductive film 22 (see FIG. 2) may be provided identical to that of the first embodiment shown in FIG. 2, or the lower conductive film 22 may not be provided on the central portion 120 (see FIG. 2) but on the peripheral portion 110 (see FIG. 2) and the support portion 130 (see FIG. 2). In addition, the cover layer of the support portion 130 may be removed as in the first embodiment or may remain as it is.

Figure 8:
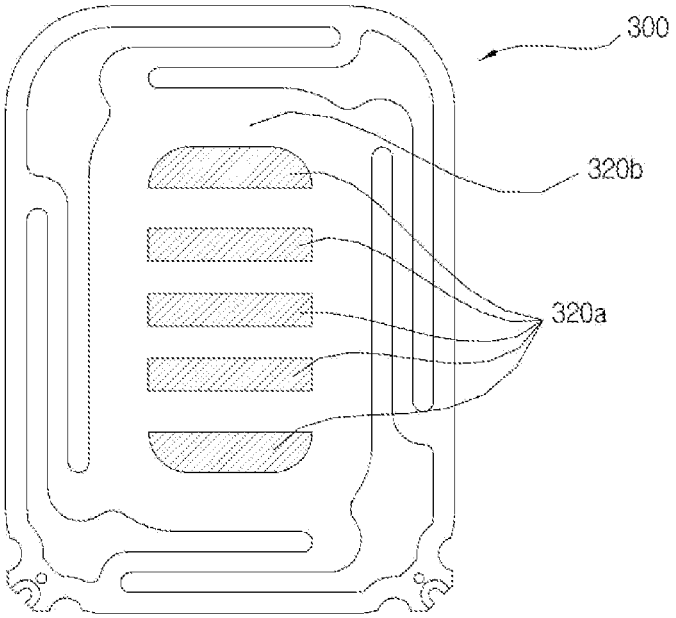
FIG. 8 is a view showing a state where part of an upper cover layer of a suspension according to a third embodiment of the present invention is removed.

FIG. 8 is a view showing a state where part of an upper cover layer of a suspension according to a third embodiment of the present invention is removed. The suspension 300 according to the third embodiment of the present invention includes a central portion-removed part 320*a* and a central portion-remaining part 320*b* as in the first embodiment, but the central portion-removed part 320*a* is different in shape from that of the first embodiment. A plurality of central portion-removed parts 320*a* are provided on the short side of the suspension 300 in the form of parallel stripes, spaced apart from one another. The lower conductive film 22 (see FIG. 2) may be provided identical to that of the first embodiment shown in FIG. 2, or the lower conductive film 22 may not be provided on the central portion 120 (see FIG. 2) but on the peripheral portion 110 (see FIG. 2) and the support portion 130 (see FIG. 2). In addition, the cover layer of the support portion 130 may be removed as in the first embodiment or may remain as it is.

Figure 9:
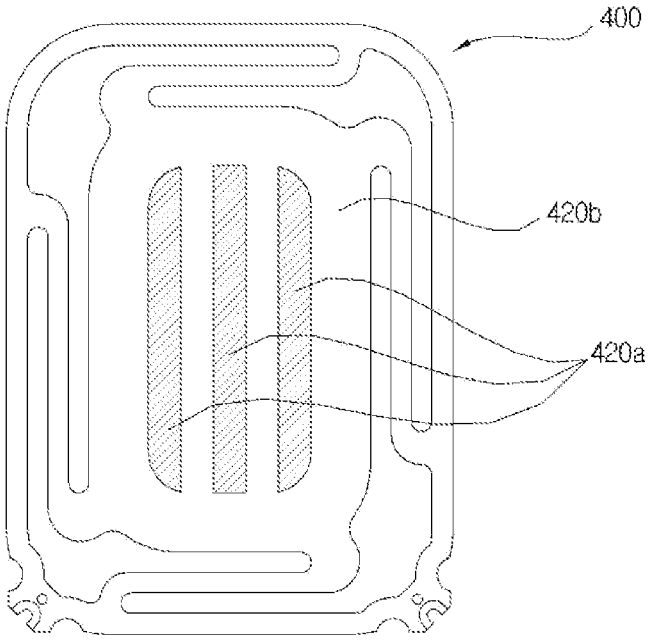
FIG. 9 is a view showing a state where part of an upper cover layer of a suspension according to a fourth embodiment of the present invention is removed.

FIG. 9 is a view showing a state where part of an upper cover layer of a suspension according to a fourth embodiment of the present invention is removed. The suspension 400 according to the fourth embodiment of the present invention includes a central portion-removed part 420*a* and a central portion-remaining part 420*b* as in the first embodiment, but the central portion-removed part 420*a* is different in shape from that of the first embodiment. A plurality of central portion-removed parts 420*a* are provided on the long side of the suspension 400 in the form of parallel stripes, spaced apart from one another. The lower conductive film 22 (see FIG. 2) may be provided on the periphery of the central portion 120 (see FIG. 2) as in the first embodiment shown in FIG. 2, or the lower conductive film 22 may not be provided on the central portion 120 (see FIG. 2) but on the peripheral portion 110 (see FIG. 2) and the support portion 130 (see FIG. 2). In addition, the cover layer of the support portion 130 may be removed as in the first embodiment or may remain as it is.

Figure 10:
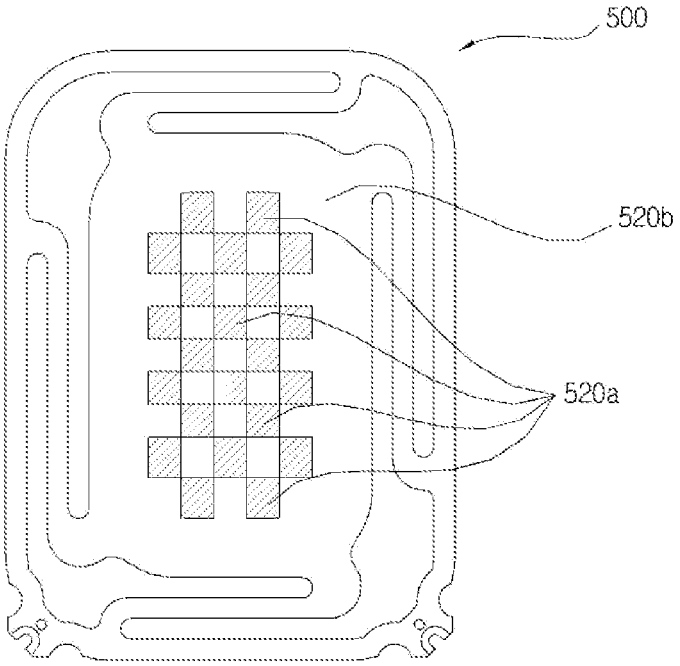
FIG. 10 is a view showing a state where part of an upper cover layer of a suspension according to a fifth embodiment of the present invention is removed.

FIG. 10 is a view showing a state where part of an upper cover layer of a suspension according to a fifth embodiment of the present invention is removed. The suspension 500 according to the fifth embodiment of the present invention includes a central portion-removed part 520*a* and a central portion-remaining part 520*b* as in the first embodiment, but the central portion-removed part 520*a* is different in shape from that of the first embodiment. The removed shape of the central portion-removed part 520*a* is a lattice shape. The lower conductive film 22 (see FIG. 2) may be provided on the periphery of the central portion 120 (see FIG. 2) as in the first embodiment shown in FIG. 2, or the lower conductive film 22 may not be provided on the central portion 120 (see FIG. 2) but on the peripheral portion 110 (see FIG. 2) and the support portion 130 (see FIG. 2). In addition, the cover layer of the support portion 130 may be removed as in the first embodiment or may remain as it is.

Figure 11:
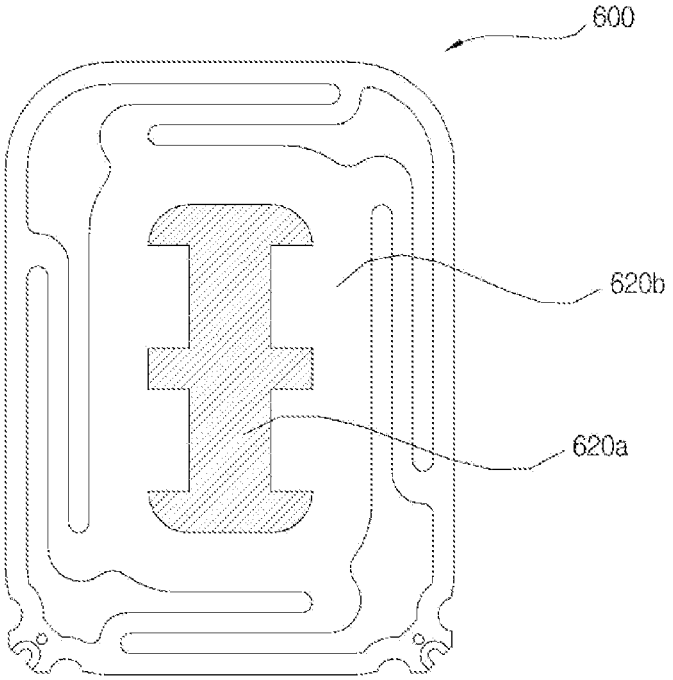
FIG. 11 is a view showing a state where part of an upper cover layer of a suspension according to a sixth embodiment of the present invention is removed.

FIG. 11 is a view showing a state where part of an upper cover layer of a suspension according to a sixth embodiment of the present invention is removed. The suspension 600 according to the sixth embodiment of the present invention includes a central portion-removed part 620*a* and a central portion-remaining part 620*b* as in the first embodiment, but the central portion-removed part 620*a* is different in shape from that of the first embodiment. The central portion-removed part 620*a* is formed in a fishbone shape. That is, a plurality of central portion-removed parts 620*a* are provided such that linearly-removed parts parallel to the long side of the suspension 600 can cross the removed parts parallel to the short side of the suspension 600. The lower conductive film 22 (see FIG. 2) may be provided on the periphery of the central portion 120 (see FIG. 2) as in the first embodiment shown in FIG. 2, or the lower conductive film 22 may not be provided on the central portion 120 (see FIG. 2) but on the peripheral portion 110 (see FIG. 2) and the support portion 130 (see FIG. 2). In addition, the cover layer of the support portion 130 may be removed as in the first embodiment or may remain as it is.

Figure 12:
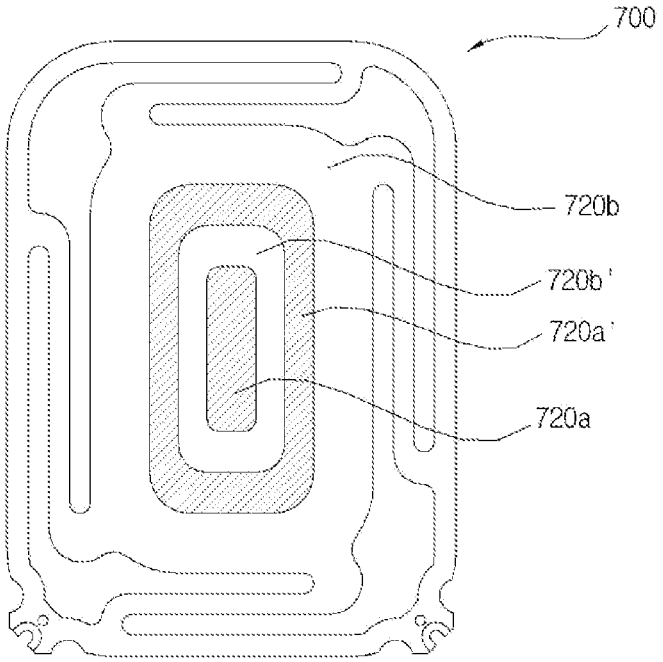
FIG. 12 is a view showing a state where part of an upper cover layer of a suspension according to a seventh embodiment of the present invention is removed.

FIG. 12 is a view showing a state where part of an upper cover layer of a suspension according to a seventh embodiment of the present invention is removed. The suspension 700 according to the seventh embodiment of the present invention includes a central portion-removed part and a central portion-remaining part as in the first embodiment, but the central portion-removed part is different in shape from that of the first embodiment. The central portion-removed part includes an inner removed part 720*a*, and an outer removed part 720*a*' which is formed in a ring shape to enclose the inner removed part 720*a* with a gap. The remaining part also includes an inner remaining part 720*b*' disposed between the inner removed part 720*a* and the outer removed part 720*a*' and an outer remaining part 720*b* disposed outside the outer removed part 720*a*'. The lower conductive film 22 (see FIG. 2) may be provided on the periphery of the central portion 120 (see FIG. 2) as in the first embodiment shown in FIG. 2, or the lower conductive film 22 may not be provided on the central portion 120 (see FIG. 2) but on the peripheral portion 110 (see FIG. 2) and the support portion 130 (see FIG. 2). In addition, the cover layer of the support portion 130 may be removed as in the first embodiment or may remain as it is.

What is claimed is:

1. A suspension for a sound transducer that includes a central portion serving as a center diaphragm, a peripheral portion, and support portions for connecting the central portion to the peripheral portion, the suspension comprising: a base film, a conductive film attached on the base film by means of an adhesive, and a cover layer attached on the conductive film by an adhesive, wherein at least part of the cover layer disposed on the central portion is removed, wherein the conductive film disposed on the central portion is provided in such a shape that a split vibration does not occur in high frequency regions by the removed part of the cover layer.

2. The suspension for the sound transducer as claimed in claim 1, wherein at least part of the cover layer disposed on the support portions is removed.

3. The suspension for the sound transducer as claimed in claim 2, wherein the support portions are provided in four directions, respectively, which include a pair of long support portions and a pair of short support portions, the cover layer disposed on the long support portions is entirely removed, and only parts of the cover layer disposed on the short support portions that are adjacent to the central portion are removed.

4. The suspension for the sound transducer as claimed in claim 1, wherein the conductive film disposed on the central portion is entirely removed, except part of the periphery of the central portion.

5. The suspension for the sound transducer as claimed in claim 1, wherein the conductive film and the cover layer are attached to both faces of the base film, and only the cover layer on the central portion that is attached to one face is removed.

6. The suspension for the sound transducer as claimed in claim 1, wherein the conductive film and the cover layer are attached to both faces of the base film, and at least parts of the respective cover layers on the central portion are removed.

7. The suspension for the sound transducer as claimed in claim 1, wherein the conductive film and the cover layer are attached to both faces of the base film, and at least part of the cover layer on the central portion that is attached to one face is removed.

8. The suspension for the sound transducer as claimed in claim 1, wherein a center part of the cover layer disposed on the central portion is removed, except its periphery.

9. The suspension for the sound transducer as claimed in claim 1, wherein plural parts of the cover layer disposed on the central portion are removed so that the removed parts can be formed in a stripe shape, spaced apart from one another.

10. The suspension for the sound transducer as claimed in claim 1, wherein the cover layer disposed on the central portion is removed so that the removed part can be formed in a lattice shape.

11. The suspension for the sound transducer as claimed in claim 1, wherein the cover layer disposed on the central portion is removed so that the removed part can be formed in a fishbone shape.

12. The suspension for the sound transducer as claimed in claim 1, wherein the cover layer disposed on the central portion is removed so that the removed part can include an inner removed part and an outer removed part which is formed in a ring shape to enclose the inner removed part with a gap.

13. A suspension for a sound transducer that includes a central portion serving as a center diaphragm, a peripheral portion, and support portions for connecting the central portion to the peripheral portion, the suspension comprising: a base film, a conductive film attached on the base film by means of an adhesive, and a cover layer attached on the conductive film by an adhesive, wherein at least part of the cover layer disposed on the central portion is removed, wherein the support portions are provided in four directions, respectively, which include a pair of long support portions and a pair of short support portions, wherein the cover layer disposed on the long support portions is entirely removed, and wherein only parts of the cover layer disposed on the short support portions that are adjacent to the central portion are removed.

* * * * *